US005626031A

United States Patent [19]

Motohashi et al.

[11] Patent Number: 5,626,031

[45] Date of Patent: May 6, 1997

[54] AIR CONDITIONER

[75] Inventors: Hideaki Motohashi, Shizuoka-ken; Kokichi Furuhama, Tokyo; Megumi Komazaki; Tetsuo Sano, both of Shizuoka-ken, all of Japan

[73] Assignee: Kabushiki Kaisha Toshiba, Kawasaki, Japan

[21] Appl. No.: 614,252

[22] Filed: Mar. 12, 1996

[30] Foreign Application Priority Data

Mar. 14, 1995 [JP] Japan ..... 7-054381

[51] Int. Cl.[6] ..... F25B 39/00

[52] U.S. Cl. ..... 62/502; 62/507; 62/515; 165/110

[58] Field of Search ..... 62/502, 498, 506, 62/507, 515, 524, 525, 114; 165/110, 111

[56] References Cited

U.S. PATENT DOCUMENTS

| | | | |
|---|---|---|---|
| 4,978,467 | 12/1990 | Shankland et al. | 62/114 X |
| 5,009,262 | 4/1991 | Halstead et al. | 62/507 X |
| 5,372,188 | 12/1994 | Dudley et al. | 165/110 |
| 5,438,849 | 8/1995 | Yoshida et al. | 62/498 |
| 5,542,271 | 8/1996 | Kudoh et al. | 62/502 |

*Primary Examiner*—Harry B. Tanner
*Attorney, Agent, or Firm*—Foley & Lardner

[57] ABSTRACT

In an air conditioner having at least an indoor unit 9 and an outdoor unit 11 through which a coolant flows, a saturation temperature of the coolant at 50° C. is not less than 2500 kPa, and the indoor heat exchanger in the indoor unit satisfies a relationship of $Hi \times Li/(Di^3 \times Ni^2) \geqq 150$ and the outdoor heat exchanger in the outdoor unit satisfies a relationship of $Ho \times Lo/(Do^3 \times No^2) \geqq 60$.

14 Claims, 6 Drawing Sheets

AIR CONDITIONER

BACKGROUND OF THE INVENTION

1. Field of the Invention

The present invention relates to an air conditioner having an indoor heat exchanger and an outdoor heat exchanger of a small-sized type without decreasing the performance or ability of the air conditioner.

2. Description of the Prior Art

In general, an indoor unit in an air conditioner has an indoor heat exchanger and an outdoor unit in it has an outdoor heat exchanger.

As shown in FIG. 1A, the heat exchanger comprises a plurality of fins 101 and a heat exchanger tube 103 which is located through the plurality of fins 101. In this case, the heat exchanger tube 103 has a one path configuration.

Now, we explain about the number of paths of the heat exchanger tube. As shown in FIG. 1A, a heat exchanger tube 103 of a one path type from the inlet side to the outlet side is referred to as "a one path type". As shown in FIG. 1B, a heat exchanger tube 103 is branched into two paths at the inlet side of it and the branched two paths are grouped to a one heat exchanger tube at the outlet side of it. This type configuration is called as "a two path type". In addition, as shown in FIG. 1C, a heat exchanger tube 103 has a one path at the inlet side and it is branched into two path at a mid-point and the two path is grouped to a one path at the outlet side of it. This type configuration is referred to as "1–2 path type". As shown in FIG. 1D, a heat exchanger tube 103 is branched into two paths at the inlet side and the two paths are further branched into three paths at the outlet side of it. This type configuration is referred to as a "2-3 path type". Thus, there are various path types based on a combination of the number of branches in a heat exchanger tube. These type configurations of the heat exchanger tube are examples.

In a heat exchanger, a heat exchanging operation is performed between a coolant flowing in the heat exchanger tube 103 and an air flowing between the fins 101. Important factors in order to change the ability of a coolant are a pressure loss Δ P and a heat transfer coefficient α. As you know, when the pressure loss Δ P becomes smaller and the heat transfer coefficient α is greater, the efficiency of the heat exchanging operation in the heat exchanger becomes high.

By the way, the heat transfer coefficient α is expressed by a relationship between the Nusselt number and the Reynolds number. Thus, we can obtain the following relationship expression:

$$\alpha \cdot D/\lambda = C1 \cdot ((M/A) \cdot D/\mu)^{c2},$$

where M is a circulating amount of a coolant, λ is a heat transfer coefficient, μ is a viscosity coefficient, D is a diameter of a heat exchanger tube, A is a cross section area, and C2 is a constant.

When C2≈1 and N is the number of paths, we obtain the following relationship:

$$\alpha \propto M \cdot (\lambda/\mu)/(D2 \cdot N) \quad (1)$$

On the other hand, the pressure loss Δ P is a function of a dynamical pressure. Therefore we obtain the following relationship:

$$\Delta P = C3 \cdot (Lm/D) \cdot \rho \cdot (M/(\rho \cdot A))^2,$$

where M is a circulating amount, D is a diameter of a heat exchanger tube, A is the cross section area, ρ is a density of a coolant, and Lm is a length of a flow path.

When Lm=L/N, L is the total length of the heat exchanger tube, the following relationship is obtained:

$$\Delta P \propto M \cdot (1/\rho) \cdot L/(D^5 \cdot N^3) \quad (2).$$

These equations (1) and (2) described above show apparently that the heat transfer coefficient α becomes greater, but the pressure loss Δ P also becomes greater when the diameter D of the heat exchanger tube is shorter and the number of the paths is smaller.

We define a total performance index or a combined performance Index for evaluating the combined performance of a heat exchanger as follows:

$$I = (\Delta P/P)/\alpha \quad (3),$$

where P is an average pressure in the heat exchanger and (Δ P/P) is a value for directly expressing that the pressure loss Δ P has an effect on the cycle efficiency of an air conditioner.

Accordingly, when the equations (1) and (2) are introduced into the equation (3), we obtain the following relationship as the circulating amount of the coolant by a displacement of M=m·H, $$I \propto (\mu/(\rho \cdot \lambda \cdot P)) \cdot m \cdot (H \cdot L/(D^3 \cdot N^2) \quad (4),$$

where m is a circulating amount of a coolant per unit output, and H is a rated output (kw) of an cooling operation.

As apparently by the equation (4) above, in order to decrease the combined performance I as small as possible, namely in order to increase the total performance of the heat exchanger, the diameter of the heat exchanger tube must be larger and the number of paths is also increased. This is easily understood based on the equation (4) above. However, when the diameter of a heat exchanger tube is larger, the size of a heat exchanger becomes greater. In addition, the number of paths is increased, a coolant cannot flow into each path uniformly. For example, a flow amount of a coolant stream into each path is a slightly different to each other. Accordingly, an designer must decrease the diameter D of a heat exchanger tube and the number N of paths during design of an air conditioner. These are important objects of the designer.

For example, in a conventional small-size indoor air conditioner using fluorocarbon-based coolant R22 as a coolant, it is generally used that the total length of a heat exchanger tube is approximately 20 meters, an outer diameter of the heat exchanger tube is approximately 35 mm, and the heat exchanger tube is a two paths type configuration. It is quite rare that a part of a heat exchanger tube is a one path type or three path type. In addition, in an outdoor heat exchanger, it is generally used that the total length of a heat exchanger tube is about 20 meters, an outer diameter of the heat exchanger tube is approximately 8 mm, and the heat exchanger tube is the two paths type configuration. It is quite rare case in an outdoor heat exchanger configuration that the diameter of the heat exchanger tube is 8 mm or 9.52 mm.

Now, in the equation (4) described above, namely in the following equation (4):

$$I \propto (\mu/(\rho \cdot \lambda \cdot P)) \cdot m \cdot (H \cdot L/(D^3 \cdot N^2) \quad (4),$$

when κ is used for the component $[H \cdot L/(D^3 \cdot N^2)]$, we obtain the results in the following TABLE-1 which are calculated by using actual data items for each of heat exchanger of conventional various types.

TABLE-1

| Type of heat exchanger | Rated output [kw] | L [mm] | D [mm] | N | κ |
|---|---|---|---|---|---|
| indoor small sized | 2.8 | 20,000 | 6.35 | 2–3 | 39.5 |
| indoor small sized | 2.8 | 20,000 | 6.35 | 2 | 54.6 |
| indoor small sized | 2.8 | 20,000 | 6.35 | 1–2 | 103.9 |
| indoor large sized | 7 | 40,000 | 6.35 | 3 | 91.8 |
| indoor large sized | 14 | 60,000 | 8 | 5 | 65.5 |
| outdoor small sized | 2.8 | 20,000 | 9.52 | 2 | 16.2 |
| outdoor small sized | 2.8 | 20,000 | 8 | 2 | 27.4 |
| outdoor small sized | 2.8 | 20,000 | 7 | 2 | 40.6 |
| outdoor large sized | 5 | 40,000 | 9.52 | 3 | 25.8 |
| outdoor large sized | 14 | 100,000 | 9.52 | 6 | 45.1 |

For example, when the entire of a heat exchanger tube in a small sized indoor heat exchanger is constructed by a one path configuration, κ becomes 218.7 which is greater than that in each case of the heat exchangers in the table 1. In this case, the performance of this small sized heat exchanger become down or decreased. This is a problem.

SUMMARY OF THE INVENTION

In view of the above, it is an object of the present invention to provide an air conditioner of a small sized in which the number of paths can be decreased and the diameter of a heat exchanger tube in it can be small without decreasing of the performance of an indoor heat exchanger and an outdoor heat exchanger incorporated in the air conditioner.

In accordance with a preferred embodiment of the present invention, there is provided an air conditioner comprising a compressor for compressing a coolant, an indoor heat exchanger, and an outdoor heat exchanger through which the coolant discharged from the compressor flows, wherein the saturation temperature of the coolant at the temperature of 50° C. is not less than 2500 kPa and the indoor air conditioner satisfies a relationship of:

$$Hi \times Li/(Di^3 \times Ni^2) \geqq 150,$$

where Hi is a cooling operation rated output (kw), Li is the total length (mm) of a heat exchanger tube, Di is the outer diameter (mm) of the heat exchanger tube, and Ni is the number of paths of the heat exchanger tube.

In addition, in the condition for the air conditioner described above, the heat exchanger tube in the air conditioner is a one path type configuration; or the cross section of the heat exchanger tube is a compressed shaped tube; or the outer diameter of the heat exchanger tube is not more than 6 mm; or the outer diameter of the heat exchanger tube is not more than 4 mm and the number of the paths in the heat exchanger tube is not more than 3; or the outer diameter of the heat exchanger tube is not more than 4 mm and the number of the paths in the heat exchanger tube at the inlet side is not more than 2 and at the outlet side is not more than 4.

Furthermore, in accordance with another preferred embodiment of the present invention, there is provided an air conditioner comprising: an outdoor unit including an heat exchanger having a relationship $Ho \times Lo/(Do^3 \times No^2) \geqq 60$, where Ho is a cooling operation rated output (kw), Lo is the total length (mm) of a heat exchanger tube, Do is the outer diameter (mm) of the heat exchanger tube, and No is the number of paths of the heat exchanger tube. In this condition, the number of the paths of the outdoor heat exchanger is a one path configuration; or the outer diameter of the heat exchanger tube is not more than 6.5 mm. On the other hand, a mixture coolant of the coolant R32 and the coolant R125 is used as a coolant, and a synthesis composition of the coolant; R32 and the coolant R125 is not less than 80 percents; or the composition of the coolant R32 is not less that 50 percent.

Moreover, in accordance with another preferred embodiment of the present invention, there is provided an air conditioner comprising an compressor for compressing a coolant, an indoor heat exchanger, and an outdoor heat exchanger through which the coolant discharged from the compressor flows, wherein the saturation temperature of the coolant at 50° C. is not less than 2500 kPa and the indoor air conditioner satisfies a relationship of $Hi \times Li/(Di^3 \times Ni^2) \geqq 150$, where Hi is a cooling operation rated output (kw), L1 is the total length (mm) of a heat exchanger tube, Di is the outer diameter (mm) of the heat exchanger tube, and Ni is the number of paths of the heat exchanger tube. In addition, the air conditioner described above further comprises an outdoor unit including an heat exchanger having a relationship $Ho \times Lo/(Do^3 \times No^2) \geqq 60$, where Ho is a cooling operation rated output (kw), Lo is the total length (mm) of a heat exchanger tube, Do is the outer diameter (mm) of the heat exchanger tube, and No is the number of paths of the heat exchanger tube.

When the air conditioner of the preferred embodiment of the present invention described above is compared with a conventional air conditioner only using a fluorocarbon-based coolant R22, a pressure of the coolant of the preferred embodiment is 1.62 times at a lower pressure side, 1.35 times in a density, 1.1 times in a heat transfer coefficient, and 0.86 times in a circulating amount or a circulating flow amount. Therefore it can be achieved to decrease a path number of a heat exchanger tube and the diameter of the heat exchanger tube without decreasing performance and provide a small sized air conditioner. These and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, an air conditioner as a preferred embodiment according to the present invention will be explained with reference to FIGS. 2 to 6.

Figure 1A:
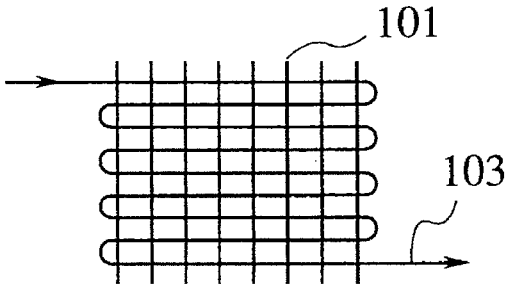
FIGS. 1A to 1D are explanational diagrams showing path number of a heat exchanger tube in a heat exchanger.
Figure 1B:
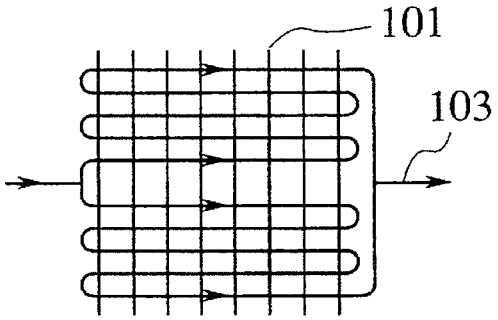
Figure 1C:
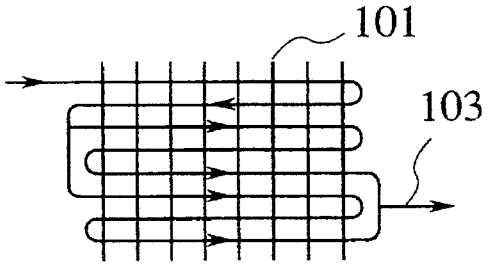
Figure 1D:
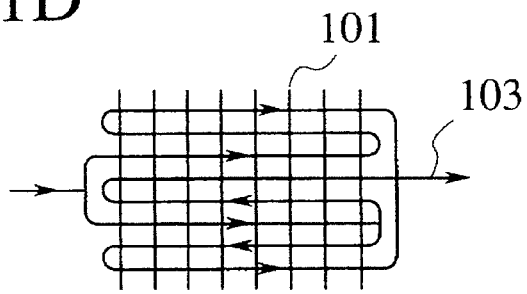
Figure 2:
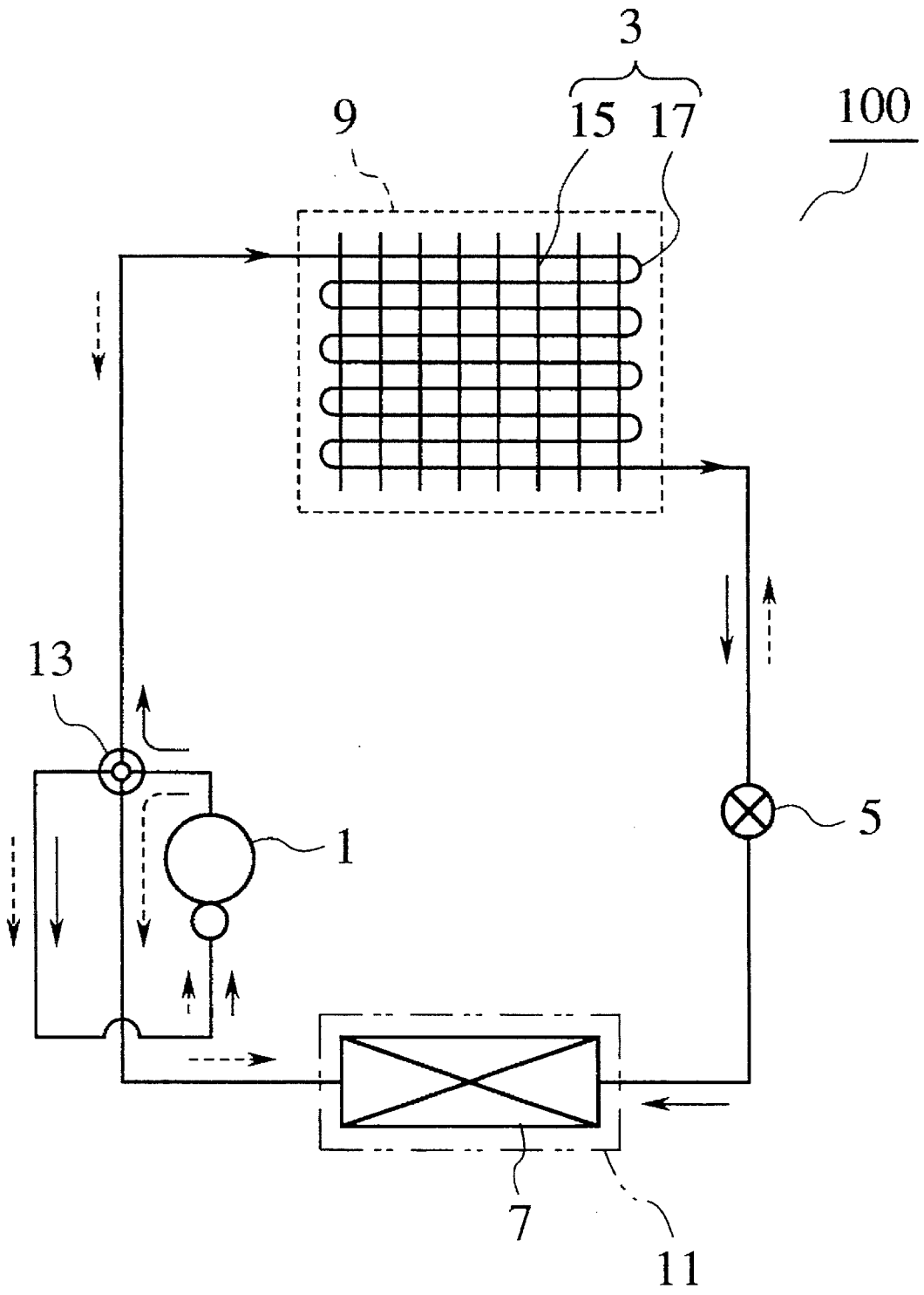
FIG. 2 is a block diagram showing an entire configuration of an air conditioner of a preferred embodiment according to the present invention.

In the air conditioner as a preferred embodiment of the present invention as shown in FIG. 2, a reference number 1 designates a compressor in the air conditioner for compressing a coolant, a reference number 3 denotes an indoor heat exchanger, a reference number 5 designates a throttle device or a throttle valve, a reference number 7 denotes an outdoor heat exchanger. The indoor heat exchanger 3 is placed in an indoor unit 9. The outdoor heat exchanger 7 is placed in the outdoor unit 11 and operates a cooling operation and a heating operation under the control of a four-way valve 13 whose operation is also controlled by a controller (not shown). In other word, the coolant compressed by and discharged from the compressor 1, as shown by the solid lines in FIG. 2, flows through the indoor heat exchanger 3, the throttle device 5, the outdoor heat exchanger 7, and the compressor 1. This flow is repeated, namely the coolant flows circulately in the air conditioner for the cooling or heating operations. In addition, in the heating operation, the coolant discharged from the compressor 1 flows,as shown by the dotted lines in FIG. 2, through the outdoor heat exchanger 7, the throttle device 5, the indoor heat exchanger 3, and the compressor 1. This flow is also repeated.

In the air conditioner of the embodiment 1, a mixture coolant of the coolant R32 and the coolant 125 whose synthesis composition in the coolant is not less than 80 weight percents is used. It can be acceptable to use a mixture coolant of the coolant R32 and the coolant R125 whose synthesis composition in the coolant is not less than 50 weight percents.

Figure 3:
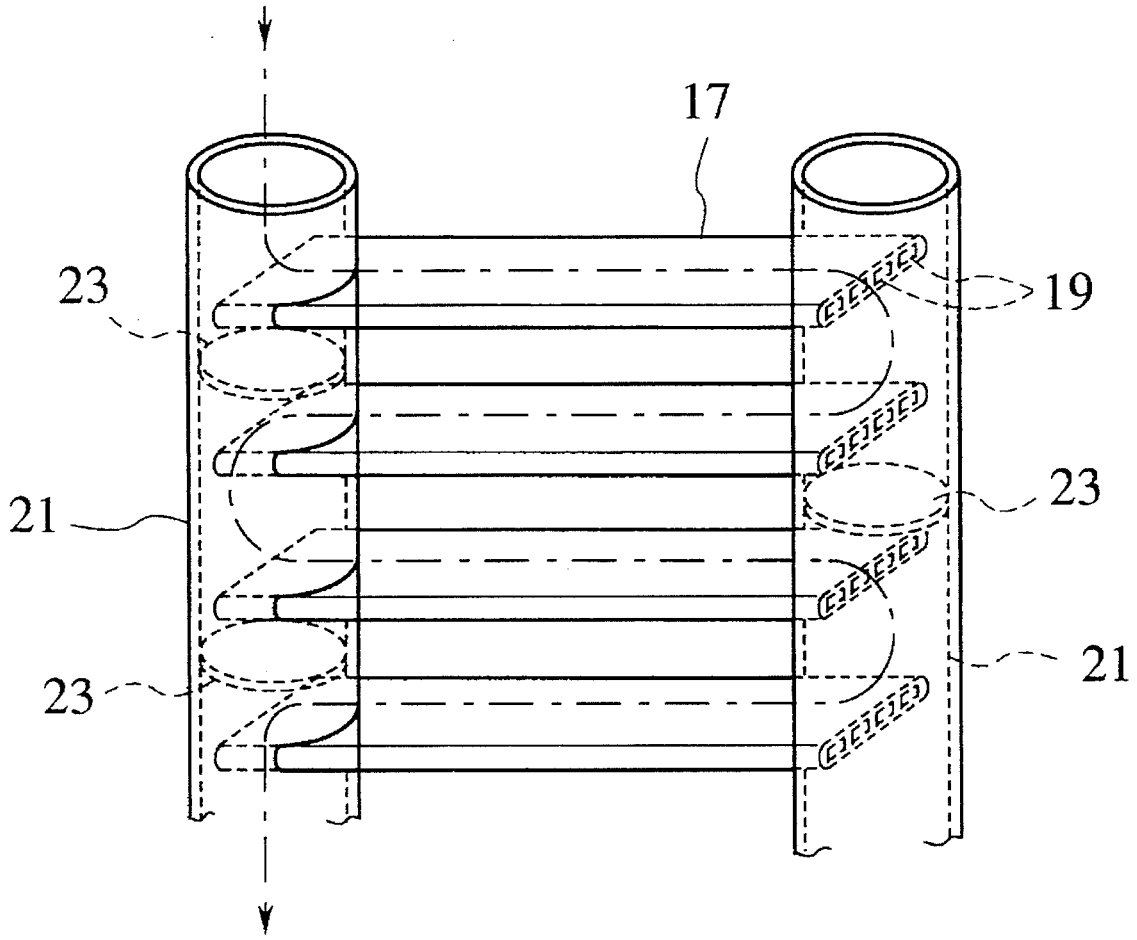
FIG. 3 is a diagram showing a configuration of a heat exchanger tube of a compressed shape used in the air conditioner as shown in FIG. 2.

On the other hand, the indoor heat exchanger 3 comprises a plurality of fins 15 and a plurality of heat exchanger tubes 17 through which the coolant or the mixture coolant flows and which penetrate the plurality of fins 15. These plurality of fins 17 has the one path configuration and the diameter of each fin 17 is not more than 6 mm. In this case, as shown in FIG. 3, it can be acceptable to form the plurality of heat exchanger tubes 17 in a compressed shape. Both ends of each heat exchanger tube 17 are connected to and communicated by headers 21. By using partition plate 23 (or divider plates) as shown in FIG. 3, the heat exchanger tubes 17 is formed by a one path configuration, namely the flow of the coolant is not branched in the heat exchanger tubes. In other words, the coolant (or the mixture coolant in this embodiment) flows only through a one path.

Figure 4:
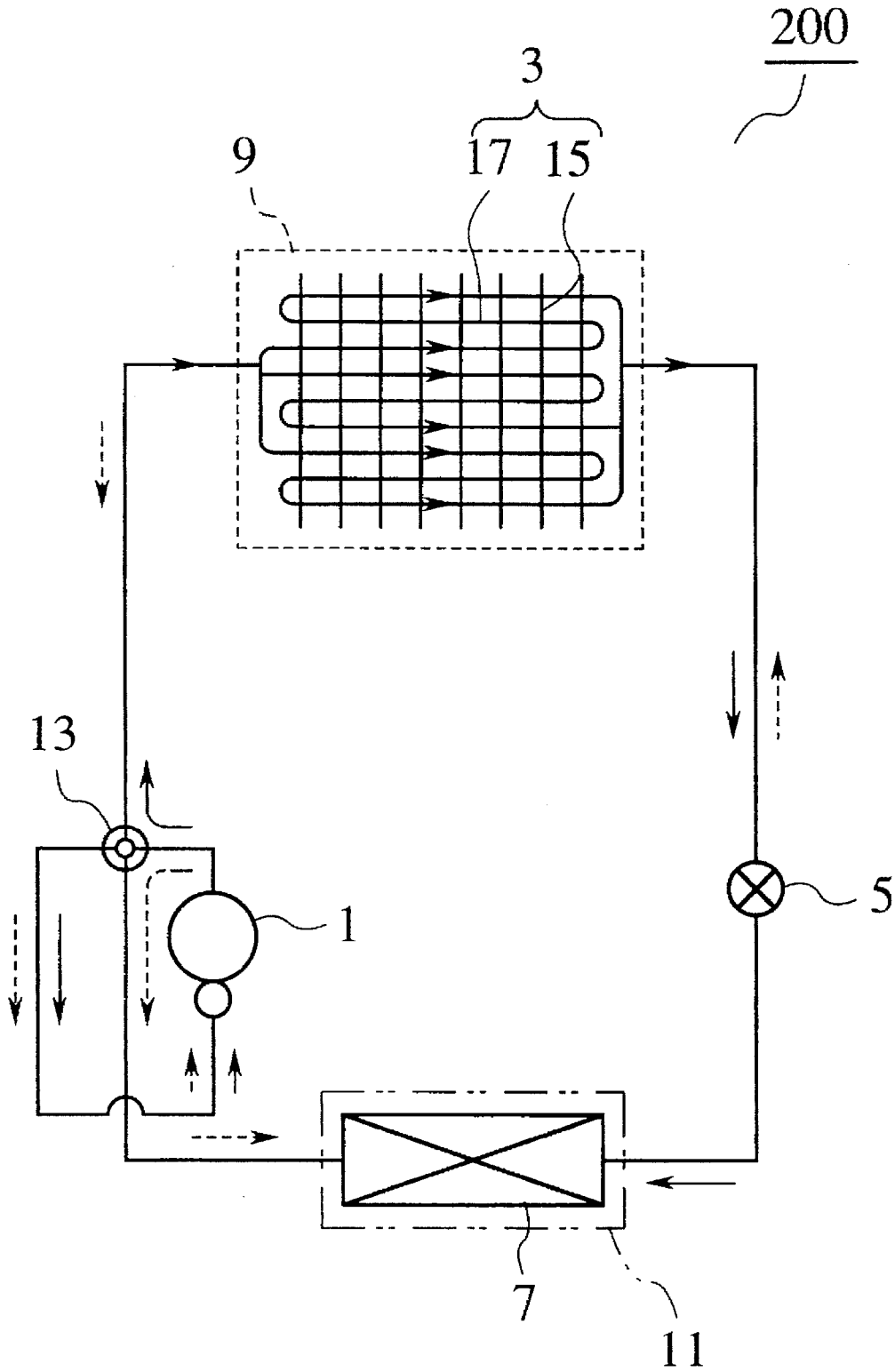
FIG. 4 Is a block diagram showing three path configuration of the heat exchanger tube used in the air conditioner as shown in FIG. 2.

In addition, as shown in FIG. 4, in an air conditioner 200 of the embodiment 2 of the present invention, it can be acceptable in the present invention that the coolant or the mixture coolant flows through the three paths or not more than three paths. In this case, the outer diameter of the heat exchanger tube 17 is 4 mm.

Figure 5:
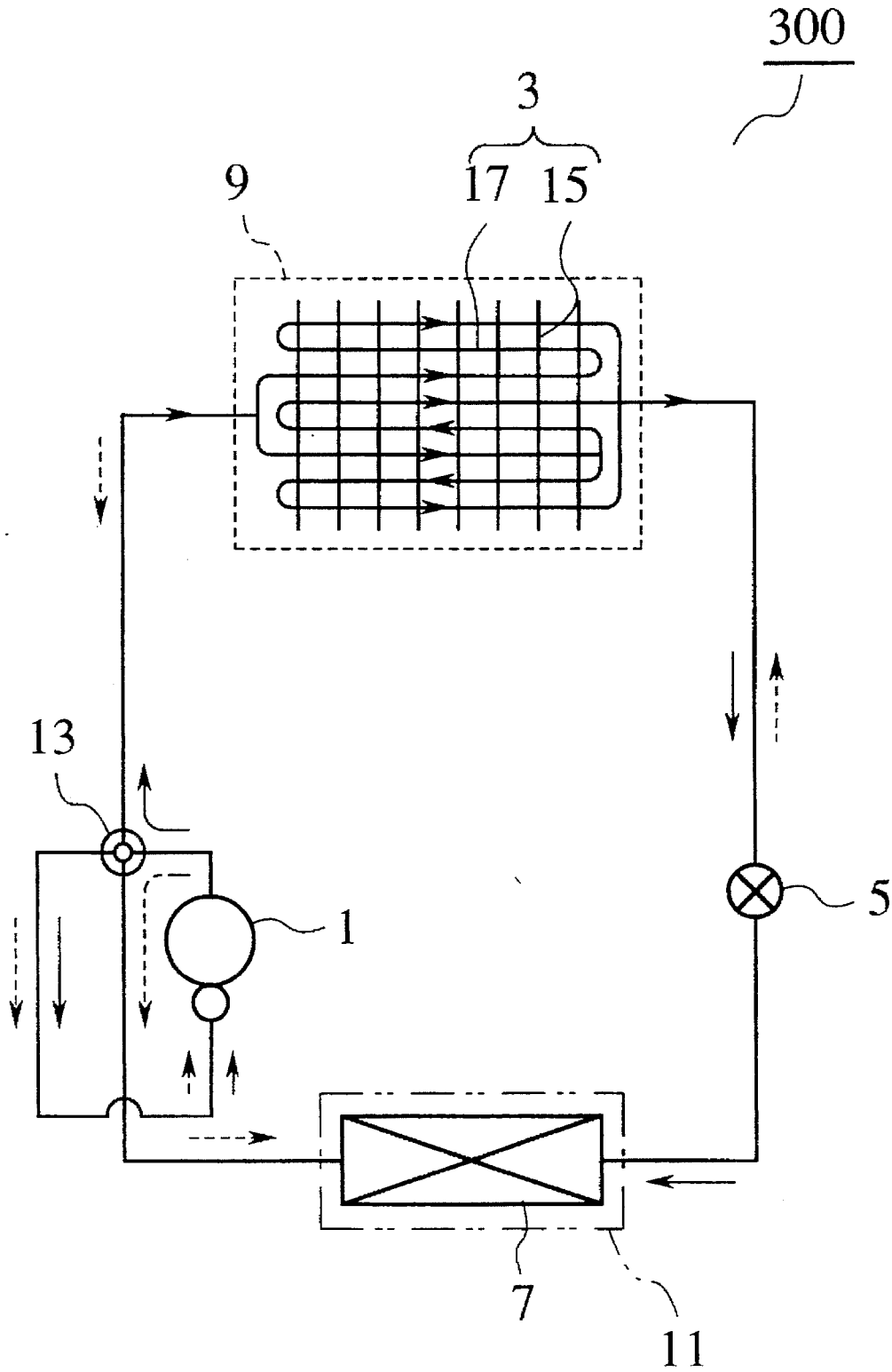
FIG. 5 is a block diagram showing a 2-3 path configuration of the heat exchanger tube used in the air conditioner as shown in FIG. 2.

Furthermore, as shown in FIG. 5, in an air conditioner 300 of the embodiment 3 of the present invention, it can also be acceptable in the present invention that the coolant or mixture coolant flows through a 2-4 paths. In this case, the outer diameter of the heat exchanger tube 17 is 4 mm.

Figure 6:
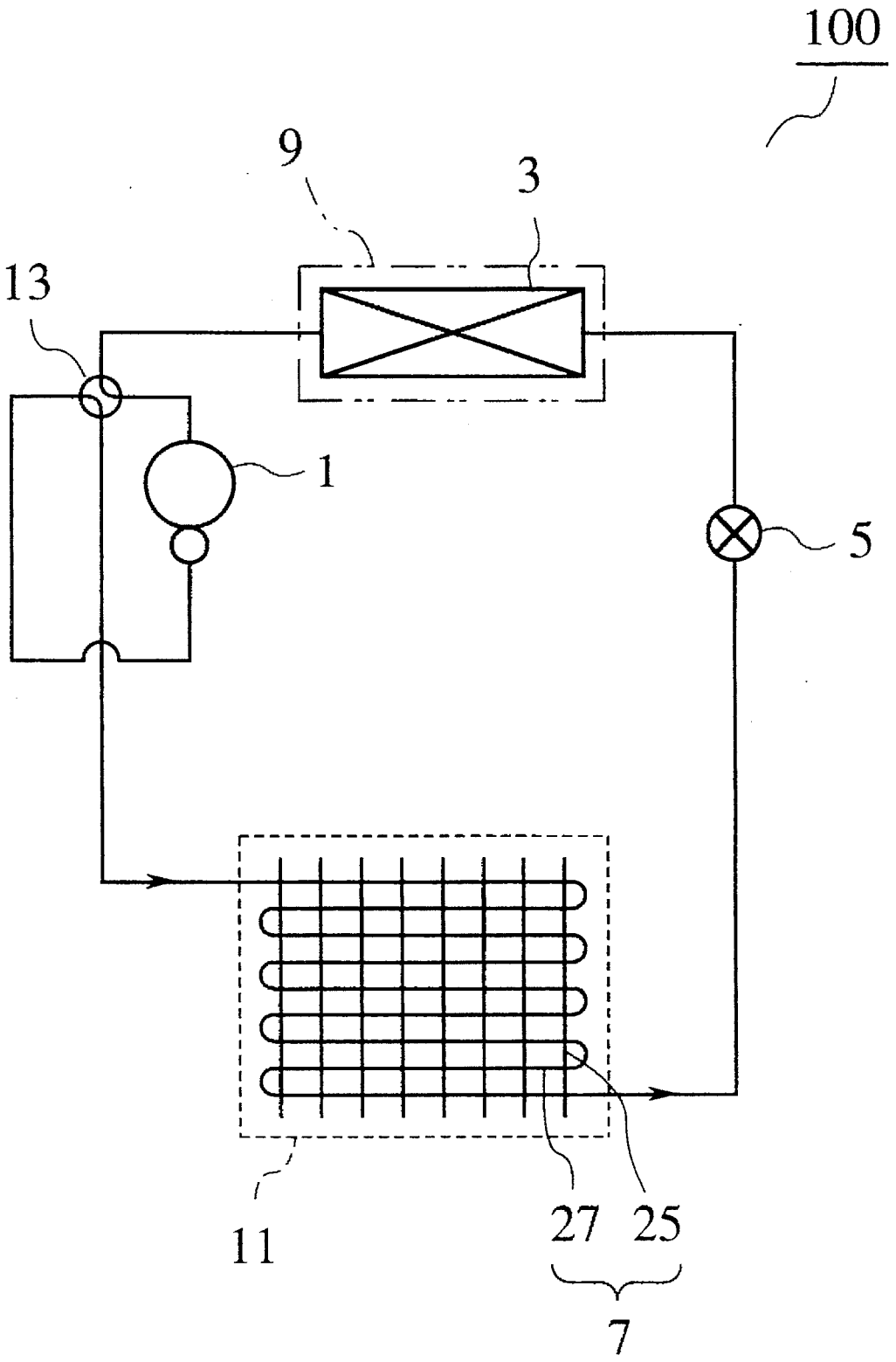
FIG. 6 is a block diagram showing a one path configuration of the heat exchanger tube used in the air conditioner as shown in FIG. 2.

As shown in FIG. 6, the outdoor heat exchanger 7 in the air conditioner 100 of the embodiment 1 comprises a plurality of fins 25 and a plurality of heat exchanger tubes 27 through which the coolant or the mixture coolant flows and which penetrate the plurality of fins 25. These plurality of fins 27 has the a one path configuration and the diameter of each fin 17 is not more than 6.5 mm.

In the air conditioner 100 having the configuration described above of the preferred embodiment 1 according to the present invention, because a coolant is the mixture coolant of the coolant R32 and the coolant R125 (or R31/125) in the outdoor heat exchanger side, the saturated pressure at 50° C. becomes 300 kPa. Other material characteristic values of coolants are shown in the following Table-2:

TABLE-2

| Coolants | T [°C.] | S.P. [kPa] | E.L.H. [kJ/kg] | V.D. [kg/m3] | H.T.C. [W/mK] | V.C. [kg/ms] |
|---|---|---|---|---|---|---|
| R22 | 0 | 500 | 205 | 21.2 | $9.5 \times 10^{-2}$ | $2.1 \times 10^{-4}$ |
| R22 | 10 | 680 | 197 | 28.8 | $9.0 \times 10^{-2}$ | $1.9 \times 10^{-4}$ |
| R32/R125 | 0 | 810 | 243 | 28.5 | 0.11 | $1.7 \times 10^{-4}$ |
| R32/R125 | 10 | 1100 | 229 | 39.0 | 0.10 | $1.9 \times 10^{-4}$ |

where, T is a Temperature, S.P. is a Saturated Pressure, E.L.H. is an Evaporation Latent Heat, V.D. is a Vapor Density, H.T.C is a Heat Transfer Coefficient, and V.C. is a Viscosity Coefficient.

Here, Di is the outer diameter of the heat exchanger tube, Ni is the number of paths of the heat exchanger tube, Li is the total length of the heat exchanger tube 17 in the indoor heat exchanger 3. When the mixture coolant (R32/R125) used in the air conditioner of the present invention is compared with the conventional fluorocarbon-based coolant (R22) in the combined performance index I, the following difference between them is obtained: From the equation (4) described above, $$(I(R22)/I(R32/125)) = [(\mu(R22)/\mu(R32/125)) \cdot (\rho(R32/125)/\rho(R22)) \times (\lambda(R32/125)/\lambda(R22)) \cdot (P(R32/125)/P(R22)) \times (m(R22)/M(R32/125))] \cdot (\kappa(R22)/\kappa(R32/125)),$$

where $\kappa$ is $[Hi \cdot Li/(Di^3 \cdot Ni^2)]$ which has been prescribed.

By the way, because the vapor temperature of the coolant in the indoor heat exchanger 3 is approximately 10° C., when the material characteristic value at the temperature of 10° C. is used, we obtain the following result:

$(\mu(R22)/\mu(R32/125))=1.27$;

$(\rho(R32/125)/\rho(R22))=1.35$;

$(\lambda(R32/125)/\lambda(R22))=1.11$; and $(P(R32/125)/P(R22))=1.62$.

The rate of the circulating flow amount m between them is $(m(R22)/M(R32/125))=1.16$.

By using the results described above, the rate of the total or combined performance index I of this embodiment becomes approximately 3.6.

Therefore the rate of the total performance index I between them is expressed by the following relationship:

$$I(R22)/I(R32/125)=3.6\cdot(\kappa(R22)/\kappa(R32/125)) \quad (5)\cdot$$

By using the relationship (5) described above, the rate of κ between them becomes (κ(R22)/κ(R32/125))=1/3.6. In other words, when the mixture coolant (R32/125) is used, even if κ of the mixture coolant (R32/125) becomes 3.6 times of the coolant R22, the value of the total performance index I of the case using the mixture coolant (R32/125) becomes approximately equal to the case using the coolant R22.

In a small sized air conditioner (rated output 2.8 Kw), when the mixture coolant (R32/125) of 60/40 wt % is used, and the total length Li of the heat exchanger tube 17 in the indoor heat exchanger is 2,000 mm, the outer diameter Di of the heat exchanger tube 17 in the indoor heat exchanger is 6 mm, and the number of the path is one, the value κ becomes 218.7. However, when the total performance index I of the small sized air conditioner of the embodiment above is compared with the value I of the conventional air conditioner using the coolant R22, I(R22)/I(R32/125) becomes 1.71. Specifically, the total performance index I of the embodiment is smaller than that of the conventional one, however, the total performance of the embodiment becomes higher than that of the conventional case, as clearly described above.

Next, as shown in FIG. 3, when the compressed heat exchanger tube 17, the mixture coolant (R32/125) of 60/40 wt %, the heat exchanger tubes of 5 paths (namely, they are 2 mm×2 mm×5) are used and the diameter Di of each heat exchanger tube 17 is 2 mm, the number of the paths is 5, and the total length of the heat exchanger tubes is 12,000 mm, the value κ (R32/125) becomes 168. In this case, the number of the heat exchanger tubes is 12 and these heat exchanger tubes are connected in series and there is no branch of the flow at a header side of the heat exchanger tubes.

Here, the rate of the total performance index between them is as follows:

$$I(R22)/I(R32/125)=3.6\times51.8/168=1.11.$$

The total performance index I of the embodiment is smaller than that of the conventional one using the coolant (R22). In other word, the performance of the air conditioner of the embodiment is higher than that of the conventional air conditioner. In addition, because there is no branch flow at the header side, the coolant flow is smoothly branched into each heat exchanger tube at points or nodes other than the header side.

Next, like the air conditioner 200 as shown in FIG. 4, when diameter Di of the heat exchanger tube 17 in the heat exchanger 3 is 4 mm, the path configuration is the 2–3 path, the total length of the heat exchanger tube is 20 m, the total length of 2 path portion is 16 meters and the length of 3 path portion is 4 meters. Thus, when the path configuration is changed on the way in the heat exchanger 3, the value $\kappa=(Li/(Di^3\times Ni^2))$ of each path is calculated, and then the sum of the value of each κ is obtained, and the summation result is multiplied by a cooling operation rated output Hi. In this case, Hi is 2.8 Kw, the value κ is 175+19.3=194.3. The rate of the total performance index I becomes I(R22)/(R32/125)=1.01. The total performance of this embodiment is approximately equal to the conventional one using the coolant R22.

In the case using 2-3 path configuration, because the coolant flow is first branched into 2 paths and then into 3 paths, the coolant can smoothly flow when comparing the case of the 4 path configuration at the header side.

In addition, it can be acceptable to use the 2-4 path configuration instead of the 2-3 path configuration. Because this case is also the 2 path branch flow case, the coolant can flow smoothly like in the case of the 2-3 path configuration case.

Next, we will discuss the case of the air conditioner 300 of the embodiment 3 as shown in FIG. 5. Because the evaporation temperature of the coolant in the outdoor heat exchanger 7 is approximately 0° C., when the material characteristic values at 0° C. described above are used, the following results are obtained:

$$(\mu(R22)/\mu(R32/125))=1.27;$$

$$(\rho(R32/125)/\rho(R22))=1.35;$$

$$(\lambda(R32/125)/\lambda(R22))=1.11;\text{ and}$$

$$(P(R32/125)/P(R22))=1.62.$$

The rate of the circulating flow amount m between them becomes 1.19 (=(m(R22)/M(R32/125))).

By using the results described above, the total or combined performance index I of this case becomes 3.7.

Therefore, the rate of the total performance index I between them can be expressed by the following relationship:

$$I(R22)/I(R32/125)=3.7\cdot(\kappa(R22)/\kappa(R32/125)) \quad (6).$$

By using the relationship (6) described above, the rate of κ between them becomes (κ(R22)/κ(R32/125))=1/3.7. In other words, when the mixture coolant (R32/125) is used, even if κ of the coolant (R32/125) becomes 3.7 times of the coolant R22, the value of the total performance index I of the case using the mixture coolant (R32/125) becomes approximately equal to the case using the coolant R22.

When a heat exchanger is made by using that the mixture coolant R32/125 of 60/40 weight percent (wt %) is used, the outer diameter of the heat exchanger tube 27 is 8 mm or 9.52 mm, the value κ (R32/125) becomes 109.5 (Do=8 mm) or 65.0 (Do=9.52 mm) and the number No of paths is 1.

When the values described above are compared with the conventional case, the following rate can be obtained:

$$I(R22)/I(R32/125)=1.56(Do=9.52\text{ mm});\text{ and}$$

$$I(R22)/I(R32/125)=0.93(Do=8\text{ mm}).$$

Although the value I of the case of Do=8 mm is smaller than that of the conventional one, the difference is very small. On the other hand, when this value I of the case (Do=8 mm) is compared with the conventional case of Do=7 mm and No=2, the rate of I(R22)/I(R32/125) becomes 1.37. This case, the performance of the embodiment is increased than that of the conventional case of Do=7 mm.

When a heat exchanger is made by using that the mixture coolant R32/125 of 60/40 weight percent (wt %) is used, the outer diameter of the heat exchanger tube 27 is 6.35, although the path configuration is changed on the way of the heat exchanger tube path, the value κ can be calculated by using the equation of $\kappa=Ho\Sigma(Lo/(Do^3\times No^2))$, like the case of the indoor heat exchanger 3. Therefore, the value κ(R32/125) becomes 136.6. When this value κ(R32/125) is compared with the conventional case (the outer diameter Do=7 mm and the path number No=2), the rate (I(R22)/I(R32/125)) of the total performance index I between them is 1.10. Thus, the total performance of the embodiment is greater than that of the conventional case. In the number of the paths in this embodiment, the one path configuration is used in the first half of the heat exchanger tube and the two paths configuration is used in the remained half of the heat exchanger tube. In other words, this embodiment has the two path configuration in a part of the heat exchanger tube. Therefore this embodiment is compared with the conventional one of the 4 path configuration at the header side, the coolant can flow very smoothly through the heat exchanger tube.

In addition it can be acceptable to apply the both of the indoor and outdoor heat exchange 3 and 7 to a one heat exchanger. For example, it can be made an air conditioner using the mixture coolant of R32/125 of 60/40 weight percent (wt %) comprising the indoor heat exchanger 3 (D1=6.35 mm) and the outdoor heat exchanger 7 (Do=8 mm) in a one path configuration (Ni=1 and No=1). In addition, it can be acceptable to form air conditioners based on other combinations.

Furthermore, the present invention provides other coolants such as a mixture coolant of R23/32/125, a mixture coolant of R32/125/$Co_2$, a coolant of R32/$Co_2$ and the like.

The following Table-3 shows material characteristic values of the mixture coolant #1 (R23/32/125) of 5/60/35 weight percent, and the mixture coolant #2 (R32/125/$Co_2$) of 60/30/10 weight percent at the temperature 10° C. as other embodiments of the present invention.

TABLE-3

| Coolants | T [°C.] | S.P. [kPa] | E.L.H. [kJ/kg] | V.D. [kg/m3] | H.T.C. [W/mK] | V.C. [kg/ms] |
|---|---|---|---|---|---|---|
| R22 | 10 | 680 | 197 | 28.8 | $9.0 \times 10^{-2}$ | $1.9 \times 10^{-4}$ |
| #1 | 10 | 1140 | 231 | 38.1 | 0.11 | $1.4 \times 10^{-1}$ |
| #2 | 10 | 1240 | 243 | 38.8 | 0.12 | $1.4 \times 10^{-4}$ |

Where, T is a Temperature, S.P. is a Saturated Pressure, E.L.H. is an Evaporation Latent Heat, V.D. is a Vapor Density, H.T.C. is a Heat Transfer Coefficient, V.C. is a Viscosity Coefficient, #1 is the mixture coolant of (R23/32/125) of 5/60/35 weight percent, and #2 is the mixture coolant of (R32/125/$Co_2$) of 60/30/10 weight percent.

In the Table-3, the rate (κ#1/κR22) and the rate (κ#1/κR22) become 1:4.3 and 1:5.5, respectively, when the rate of the total performance index I between the mixture coolants (I(R22)/(R32/R125)) becomes 1. In this case, the total performance of the embodiment is equal to that of the conventional one. Therefore this coolant can be used for the air conditioner of the present invention.

In addition, in the heat exchanger in the embodiments of the present invention, the following conditions (4-1) to(4-2) must be satisfied: (4-1) The total length of the heat exchanger tube 17 is notchanged greatly; (4-2) Both sides of paths in the heat exchanger tube, namely the inlet side and the outlet side of the heat exchanger tube in each heat exchanger are not placed at same side, namely both sides of the paths are not positioned only at the inlet side or not located only at the outlet side; and (4-3) Any path of the heat exchanger tube must be branched at the inlet side or at the outlet side, not on the way of the heat exchanger tube.

The following Table-4 shows the relationships between the number of paths and the conditions (4-1) to (4-3) described above.

TABLE-4

| Path Number | Number of H.E. 1 | 2 | 3 | 4 | 5 | 6 | 7 | 8 | 9 | 10 |
|---|---|---|---|---|---|---|---|---|---|---|
| 1 | ○ | Δ | ○ | Δ | ○ | Δ | ○ | Δ | ○ | Δ |
| 2 | | ○ | | Δ | | ○ | | Δ | | ○ |
| 3 | | | ○ | | | Δ | | | ○ | |
| 1–2 | | | Δ | ○ | ○ | ○ | ○ | ○ | ○ | ○ |
| 2–3 | | | | | Δ | | ○ | ○ | Δ | Δ |

Where, H.E. is a Heat Exchanger, a reference character "○" designates the condition satisfying (4-1) and (402) and a reference character "Δ" denotes the condition satisfying (4-3), not (4-2).

As described in detail, the present invention provides the air conditioners of a small-sized type of the embodiments in which the number of paths can be decreased, the diameter of a heat exchanger tune can also be decreased, a coolant can flow smoothly into branched paths without decreasing of performance of the air conditioner.

Although the present invention has been described and illustrated in detail, it is clearly understood that the same is by way of illustration and example only and is not to be taken by way of limitation, the spirit and scope of the present invention being limited ,only by the term of the appended claims.

What is claimed is:

1. An air conditioner comprising:

a compressor for compressing a coolant and for discharging said coolant;

an indoor unit comprising an indoor heat exchanger through which said coolant flows; and an outdoor unit comprising an outdoor heat exchanger through which said coolant flows, wherein a saturation temperature of said coolant at 50° C. is not less than 2500 kPa, and said indoor heat exchanger in said indoor unit satisfies a relationship of Hi×Li/(Di3×Ni2)≧150, where Hi is a cooling operation rated output (kw), Li is a total length (mm) of a heat exchanger tube, Di is the outer diameter (mm) of said heat exchanger tube, and Ni is the number of paths of said heat exchanger tube.

2. An air conditioner as claimed in claim 1, wherein the path of said heat exchanger tube in said indoor heat exchanger in said indoor unit has a one path configuration.

3. An air conditioner as claimed in claim 1, wherein a cross section of said heat exchanger tube in said indoor heat exchanger in said indoor unit has a compressed shape.

4. An air conditioner as claimed in claim 1, wherein an outer diameter of said heat exchanger tube in said indoor heat exchanger is not more than 6 mm.

5. An air conditioner as claimed in claim 1, wherein an outer diameter of said heat exchanger tube is not more than 4 mm and the number of said paths is not more than 3.

6. An air conditioner as claimed in claim 1, wherein an outer diameter of said heat exchanger tube is not more than 4 mm, the number of said paths is 2 at an inlet side of said heat exchanger tube and is 4 at an outlet side of said heat exchanger tube.

7. An air conditioner as claimed in claim 1, wherein said coolant is a mixture coolant of R32 and R125, and a synthesis composition rate of said mixture coolant is not less than 80 weight percent.

8. An air conditioner as claimed in claim 1, wherein said coolant is a mixture coolant including R32, and a synthesis composition rate of said mixture coolant is not less than 500 weight percents.

9. An air conditioner comprising:

a compressor for compressing a coolant and for discharging said coolant;

an indoor unit comprising an indoor heat exchanger through which said coolant flows; and an outdoor unit comprising an outdoor heat exchanger through which said coolant flows, wherein a saturation temperature of said coolant at 50° C. is not less than 2500 kPa, and said outdoor heat exchanger in said outdoor unit satisfies a relationship of $Ho \times Lo/(Do^3 \times No^2) \geqq 60$, where Ho is a cooling operation rated output (kw), Li is a total length (mm) of a heat exchanger tube, Di is the outer diameter (mm) of said heat exchanger tube, and No is the number of paths of said heat exchanger tube.

10. An air conditioner as claimed in claim 9, wherein the path of said heat exchanger tube in said outdoor heat exchanger in said outdoor unit has a one path configuration.

11. An air conditioner as claimed in claim 9, wherein an outer diameter of said heat exchanger tube in said outdoor heat exchanger is not more than 6.5 mm.

12. An air conditioner as claimed in claim 9, wherein said coolant is a mixture coolant of R32 and R125, and a synthesis composition rate of said mixture coolant is not less than 80 weight percents.

13. An air conditioner as claimed in claim 9, wherein said coolant is a mixture coolant including R32, and a synthesis composition rate of said mixture coolant is not less than 500 weight percents.

14. An air conditioner comprising:

a compressor for compressing a coolant and for discharging said coolant;

an indoor unit comprising an indoor heat exchanger through which said coolant flows; and an outdoor unit comprising an outdoor heat exchanger through which said coolant flows, wherein a saturation temperature of said coolant at 50° C. is not less than 2500 kPa, said indoor heat exchanger in said indoor unit satisfies a relationship of $Hi \times Li/(Di^3 \times Ni^2) \geqq 150$, where Hi is a cooling operation rated output (kw), Li is a total length (mm) of a heat exchanger tube, Di is the outer diameter (mm) of said heat exchanger tube, and Ni is the number of paths of said heat exchanger tube, and said outdoor heat exchanger in said outdoor unit satisfies a relationship of $Ho \times Lo/(Do^3 \times No^2) \geqq 60$, where Ho is a cooling operation rated output (kw), Li is a total length (mm) of a heat exchanger tube, Di is the outer diameter (mm) of said heat exchanger tube, and No is the number of paths of said heat exchanger tube.

* * * * *